US008895220B2

(12) United States Patent
Bensing et al.

(10) Patent No.: US 8,895,220 B2
(45) **Date of Patent: *Nov. 25, 2014**

(54) EMULSION AGGREGATION TONER FORMULATION

(71) Applicant: Lexmark International, Inc., Lexington, KY (US)

(72) Inventors: Michael James Bensing, Lexington, KY (US); Craig Michael Bartelsen, Union, KY (US); John Joseph Kraseski, Lexington, KY (US); Bryan Patrick Livengood, Nicholasville, KY (US); Jing X. Sun, Lexington, KY (US); Vincent Wen-Hwa Ting, Boulder, CO (US)

(73) Assignee: Lexmark International, Inc., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/013,227

(22) Filed: Aug. 29, 2013

(65) Prior Publication Data

US 2013/0344434 A1 Dec. 26, 2013

Related U.S. Application Data

(63) Continuation of application No. 12/206,402, filed on Sep. 8, 2008, now Pat. No. 8,551,681.

(51) Int. Cl.
*G03G 9/087* (2006.01)

(52) U.S. Cl.
USPC ..... 430/137.18; 430/109.4; 430/123.54; 430/137.14

(58) Field of Classification Search
USPC ..... 430/109.4, 137.14, 137.18, 123.54
See application file for complete search history.

(56) References Cited

U.S. PATENT DOCUMENTS

| | | | | |
|---|---|---|---|---|
| 5,571,655 | A * | 11/1996 | Mahabadi et al. | 430/137.15 |
| 6,228,313 | B1 * | 5/2001 | Miki | 264/466 |
| 8,551,681 | B2 * | 10/2013 | Bensing et al. | 430/137.18 |
| 2006/0286478 | A1 * | 12/2006 | Chung et al. | 430/109.1 |
| 2008/0153022 | A1 * | 6/2008 | Choi et al. | 430/108.7 |
| 2008/0153027 | A1 * | 6/2008 | Veregin et al. | 430/113 |
| 2008/0182193 | A1 * | 7/2008 | Agur et al. | 430/109.4 |

* cited by examiner

*Primary Examiner* — Jonathan Jelsma

(57) ABSTRACT

An emulsion aggregation toner formulation for electrophotography and a method for preparation thereof. The emulsion aggregation toner formulation includes a polyester resin emulsion formed using an extruded polyester binder resin having a broad molecular weight distribution. The extruded polyester binder resin is formed using a plurality of polyester binder resins. Further, the emulsion aggregation toner formulation comprises at least one colorant dispersion and a wax dispersion.

18 Claims, No Drawings

EMULSION AGGREGATION TONER FORMULATION

CROSS REFERENCES TO RELATED APPLICATIONS

This patent application is a continuation application of U.S. patent application Ser. No. 12/206,402, filed Sep. 8, 2008, entitled "Emulsion Aggregation Toner Formulation."

BACKGROUND

1. Field of the Disclosure

The present disclosure relates to a chemically prepared toner formulation for use in electrophotography, and more specifically, to a polyester-based emulsion aggregation toner formulation.

2. Description of the Related Art

Electrophotography is a widely used printing technique that includes generation of an image on an image-receiving medium using a toner. More specifically, the technique includes a transfer of a specific toner to the image-receiving medium with the help of electrostatic charges. Suitable examples of the image-receiving medium include, but are not limited to, paper, plastic, and textile. The technique of electrophotography is broadly used in photocopying machines, laser printers, Light-Emitting Diode (LED) printers, and the like.

In general, toners used in electrophotographic printers are of two types, namely, milled toners and chemically prepared toners or chemically processed toners (CPTs). The milled toners may be produced either by a mechanical milling/grinding process or by a jet milling process. Suitable examples of the milled toners include, but are not limited to, mechanically milled toners and jet-milled toners.

Several types of CPTs include, but are not limited to, suspension polymerization toners (SPTs), emulsion aggregation toners (EATs)/latex aggregation toners (LATs), toners made from a dispersion of pre-formed polymer in solvent (DPPTs) and CPTs made from a "chemical milling" method.

Typically, use of CPTs is preferred over use of the milled toners as the CPTs provide better print quality, better toner transfer efficiency and lower torque properties for various components of the electrophotographic printers, such as a developer roll, a fusing belt and a charge roll. Further, chemical techniques employed for preparing the CPTs allow for manufacture of toner particles with small sizes for better fusing and printing properties as opposed to the milled toners. Furthermore, size distribution and shape of the toner particles may be well controlled while preparing the CPTs for improved toner properties as opposed to the milled toners.

More specifically, the EATs have shown to have several advantages over the milled toners and other types of the CPTs. Such advantages include, but are not limited to, manufacturing of toner particles with a small particle size and narrow particle size distribution, such as from about 3 to about 10 micrometers (μm), and achieving an optimized shape of the toner particles, such as a potato-like shape. Such optimized shape of the toner particles is required for proper and efficient cleaning of the CPTs from various components of the electrophotographic printers, such as a developer roll, a charge roll and doctoring blades, in order to prevent filming/unwanted deposition of the CPTs over the components. Further, the optimized shape of the toner particles enables for proper toner transfer properties during an electrophotographic printing operation.

In a typical process used for preparing an EAT, emulsion aggregation is carried out in an aqueous system resulting in good control of both size and shape of toner particles. Further, preparation of the EAT usually involves components, such as latex binder, one or more colorants and wax. More often than not, a styrene-acrylic copolymer latex binder is used as the latex binder in emulsion aggregation process. However, use of the styrene-acrylic copolymer latex binder allows the EAT to either have a good toner fusing property with poor shipping/storage properties or have a poor toner fusing property with good shipping/storage properties. Further, such an EAT is known to exhibit poor mechanical properties in terms of durability and resistance to filming of the various components of the electrophotographic printers.

Alternatively, use of polyester binder resins has proven to be advantageous as opposed to the styrene-acrylic copolymer latex binder and other latex binders for preparing toners for electrophotography. However, the polyester binder resins are usually employed for preparing milled toners, and have rarely been employed to prepare CPTs. The polyester binder resins are manufactured using condensation polymerization technique, which is a time-consuming technique due to involvement of long polymerization cycles. Accordingly, the polyester binder resins are not preferably adapted for the emulsion aggregation process, as the process is then confined to the use of polyester binder resins having polyester polymers with low-to-moderate molecular weights. This results in preparation of polyester-based toner formulations with limited toner fusing and printing properties.

Further, the polyester binder resins are not capable of properly dispersing in the aqueous system, i.e. water, during an emulsion aggregation process due to their polar nature, pH sensitivity and gel content. More specifically, some polyester binder resins form unstable emulsions when used in the emulsion aggregation process, and thereby yield polyester-based toner formulations with poor toner properties. In addition, due to formation of unstable emulsions, it is generally not possible to use polyester binder resins with a low acid value, for example, an acid value less than about 10, and/or gel content more than about 5 percent.

However, with advancement in toner manufacturing technology, it has become possible to obtain stability in emulsions formed using the polyester binder resins. This has been achieved by dissolving the polyester binder resins in an organic solvent and then performing a phase-inversion process where water is added slowly in a drop-wise manner. Subsequently, the organic solvent is evaporated for allowing the polyester binder resins to form stable emulsions (hereinafter referred to as "polyester resin emulsions"). Suitable examples of the organic solvents include, but are not limited to, ethyl acetate, methyl ethyl ketone (MEK), methylene chloride, chloroform and tetrahydrofuran (THF). Although, polyester resin emulsions employed in conventional polyester-based toner formulations, as obtained using the emulsion aggregation process, have shown good compatibility with colorants and wax, the conventional polyester-based toner formulations so obtained have shown limited toner fusing and printing properties. Such limited toner fusing and printing properties are associated with the use of a narrow range of the polyester polymers in the polyester binder resins. More specifically and as mentioned above, polyester polymers with low-to-moderate molecular weights and low-to-moderate molecular weight distributions have usually been employed in the polyester binder resins due to time limitations associated with complex condensation polymerization techniques.

Further, a polyester binder resin formed from a polyester polymer, which is free of cross-linking, using condensation polymerization has a low molecular weight distribution with a theoretical value of about 2. Accordingly, a polyester-based toner formulation prepared using such polyester polymer in a polyester binder resin typically has a poor fusing performance and durability unless the molecular weight distribution of the polyester binder resin is broadened using a cross-linking agent. In general, cross-linked polyester binder resins are required to obtain adequate durability and shipping/storage performance. Further, the cross-linked polyester binder resins are required to obtain good fuse grade performance for a contact development process where a developer roll is rotatably disposed in contact with a photosensitive member (such as a photoconductive drum) and the developer roll applies a layer of a polyester-based toner formulation directly to a surface of the photosensitive member. However, when using a cross-linked polyester binder resin in an emulsion aggregation process, it becomes extremely difficult to break the cross-links for proper dissolution of the polyester binder resin in an organic solvent in order to form a stable emulsion for preparing a polyester-based toner formulation with good toner properties.

Additionally, it is quite difficult to prepare a polyester-based toner formulation using a combination of two or more different polyester binder resins and/or different polyester resin emulsions by the conventional emulsion aggregation process. More specifically, polyester binder resins that include different monomers, different acid values, different softening temperatures and/or different melt viscosities, tend to agglomerate differently, thereby preventing the emulsion aggregation process from achieving polyester-based toner formulations with narrow particle size distributions for better fusing and printing properties.

Accordingly, there is a need for preparing an emulsion aggregation toner formulation with a broad molecular weight distribution. Further, the emulsion aggregation toner formulation should be capable of exhibiting good fusing properties without compromising shipping/storage performance and durability thereof. Furthermore, the emulsion aggregation toner formulation should be capable of exhibiting good resistance to filming various components of electrophotographic printers and good gloss when used for printing on an image-receiving medium.

SUMMARY OF THE DISCLOSURE

In one aspect, the present disclosure provides an emulsion aggregation toner formulation for electrophotography. The emulsion aggregation toner formulation comprises a polyester resin emulsion formed using an extruded polyester binder resin having a broad molecular weight distribution. The extruded polyester binder resin is formed using a plurality of polyester binder resins. Further, the emulsion aggregation toner formulation comprises at least one colorant dispersion and a wax dispersion.

In another aspect, the present disclosure provides a method for preparing an emulsion aggregation toner formulation for electrophotography. The method comprises extruding a plurality of polyester binder resins to form an extruded polyester binder resin having a broad molecular weight distribution. Further, the method comprises preparing a polyester resin emulsion using the extruded polyester binder resin. Furthermore, the method comprises combining and agglomerating the prepared polyester resin emulsion with at least one colorant dispersion and a wax dispersion to form the emulsion aggregation toner formulation.

DETAILED DESCRIPTION

It is understood that various omissions and substitutions of equivalents are contemplated as circumstances may suggest or render expedient, but these are intended to cover the application or implementation without departing from the spirit or scope of the claims of the present disclosure. It is to be understood that the present disclosure is not limited in its application to the details of components set forth in the following description. The present disclosure is capable of other embodiments and of being practiced or of being carried out in various ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of at least one of the referenced item.

In one aspect, the present disclosure provides a polyester-based emulsion aggregation toner formulation for electrophotography. The polyester-based emulsion aggregation toner formulation may hereinafter interchangeably be referred to as a "toner formulation." The toner formulation includes a polyester resin emulsion formed using an extruded polyester binder resin having a broad molecular weight distribution. The extruded polyester binder resin is formed using a plurality of polyester binder resins (hereinafter referred to as 'polyester binder resins'). The polyester binder resins, as used herein, may be cross-linked polyester binder resins. It should be understood that such polyester binder resins may be prepared using cross-linked polyester polymers. Further, it should be apparent to a person skilled in the art that properties of the polyester polymers used in the polyester binder resins contribute to the properties of the polyester binder resins.

Each of the polyester binder resins may be one of a semi-crystalline polyester binder resin, a crystalline polyester binder resin or an amorphous polyester binder resin. Alternatively, the each of the polyester binder resins may be a polyester copolymer binder resin. A suitable example of the polyester copolymer binder resin may include, but is not limited to, a styrene/acrylic-polyester graft copolymer.

More specifically, each of the polyester binder resins may be formed using acid monomers such as terephthalic acid, trimellitic anhydride, dodecenyl succinic anhydride and fumaric acid. Further, the each of the polyester binder resins may be formed using alcohol monomers including ethoxylated and propoxylated bisphenol A.

Each of the polyester binder resins has an acid value of less than or equal to about 40 milligrams of KOH per gram (mg of KOH/gm), including all values and increments therein. It should be understood that the acid value may be due to the presence of one or more free carboxylic acid functionalities (—COOH) in the each of the polyester binder resins. More specifically and as used herein, the term, "acid value," is referred to mass of potassium hydroxide (KOH) in milligrams (mg) that is required to neutralize one gram of the each of the polyester binder resins. The acid value is therefore a measure of amount of carboxylic acid groups in the each of the polyester binder resins.

In addition, the each of the polyester binder resins, as used herein, has a peak molecular weight (Mp) of about 1,000 to about 30,000 as well as all values and increments therein, as determined by gel permeation chromatography (GPC). Moreover, each of the polyester binder resins, as used herein, has a glass transition temperature (Tg) of about 40 to about 75 degrees Celsius (° C.), as measured by differential scanning calorimetry (DSC). More specifically, the Tg, as disclosed herein, was obtained using second scan DSC onset values.

Additionally, each of the polyester binder resins has a softening temperature of about 80° C. to about 150° C.

Typical examples of the polyester binder resins of a present embodiment may include, but are not limited to, NE-701, Binder K-5, Binder L-6, NE-2158N, NE-2141N, NE-1569, FPESL-2, Binder C, TPESL series, STPL series from Kao Corporation.

Two or more polyester binder resins selected from the above-described polyester binder resins may be used to form the extruded polyester binder resin. More specifically, the polyester binder resins are subjected to melt-mixing for one or more times to breakdown cross-links of the polyester binder resins prior to the emulsion aggregation process. The extruded polyester binder resin is characterized by a cross-linked gel content of less than or equal to about 5 percent (%) as determined by a chloroform ($CHCl_3$) insolubles test that provides a percentage value based on the total weight of the resin as is known in the art. Such a percent of gel content depicts an elimination of the cross-links in the extruded polyester binder resin for a quick and easy preparation of an emulsion thereof. However, the extruded polyester binder resin still has a broad molecular weight distribution, as extrusion of the polyester binder resins is capable of retaining a significant portion of high molecular weight polymeric content, which is necessary for tolerating a rigorous electrophotographic process.

The above-described extruded polyester binder resin is employed to prepare the polyester resin emulsion of the toner formulation. The polyester resin emulsion is made by mechanically blending and/or grinding the extruded polyester binder resin. Subsequently, the blended and/or ground form of the extruded polyester binder resin is dissolved in an organic solvent to form a solution. Suitable examples of the organic solvent include, but are not limited to, alcohols, ketones (e.g. methyl ethyl ketone, MEK), tetrahydrofuran, ethyl acetate, methylene chloride, chloroform, etc. Once dissolved in the organic solvent, the solution may then be combined with an equal amount of water at a high speed. The water, as used herein, may include a base. Such base may include an inorganic base such as ammonium hydroxide ($NH_4OH$), KOH and sodium hydroxide (NaOH). Subsequently, the organic solvent may be removed by evaporation for obtaining an aqueous polyester resin emulsion. The so obtained polyester resin emulsion, comprising emulsion particles, may further undergo microfluidization if additional reduction in particle size is desired.

In addition to the polyester resin emulsion, the toner formulation includes at least one colorant dispersion (hereinafter referred to as a "colorant dispersion").

The colorant dispersion may comprise a self-dispersing colorant selected from the group consisting of dyes (which may be soluble in a given medium and capable of precipitating), pigments (which may be insoluble in a given medium), and combinations thereof. The self-dispersing colorant, as generally understood in the art and as used herein, refers to a colorant having stabilizing groups, which enable the colorant to form a stable aqueous dispersion in the absence of any additional dispersant.

Alternatively, the colorant dispersion may comprise a colorant, which may be a non self-dispersing colorant, and a dispersant. The non self-dispersing colorant may be selected from the group consisting of dyes (which may be soluble in a given medium and capable of precipitating), organic or inorganic pigments (which may be insoluble in a given medium), and combinations thereof.

The term, "colorant", as used herein for both the self-dispersing colorant and the non self-dispersing colorant, refers to a colorant that is known in the art and is commonly used for electrophotography. It should be understood that a combination of dyes or a combination of pigments may also be used as the colorant of the present disclosure. Further, the colorant is used in the range of about zero to about 15 percent by weight of the toner formulation.

The dispersant, as used with the non self-dispersing colorant, helps to disperse or dissolve the non self-dispersing colorant to form a stable dispersion thereof. More specifically, the dispersant helps in controlling size and toner properties of the particles of the non self-dispersing colorant. The dispersant may either be a surfactant, a polymeric dispersant or a combination thereof.

The surfactant and/or the polymeric dispersant generally include three components, namely, a hydrophilic component, a hydrophobic component and a protective colloid component. The surfactant, as used herein, may be a surfactant that is known in the art for dispersing non self-dispersing colorants employed for preparing toner formulations for electrophotography.

For the purpose of this description, the polymeric dispersant is a graft co-polymer, and more specifically, a ter-polymer made by a free radical polymerization process. Further, the polymeric dispersant, as used herein, has a hydrophobicity ranging from about 10 to about 90 percent by weight, and more specifically, from about 30 to about 70 percent by weight, to effectively control speed of the emulsion agglomeration process.

The hydrophilic component of the polymeric dispersant may be an ionic monomer segment. Such an ionic monomer segment may be selected either from acrylic acid, methacrylic acid, carboxyethylacrylic acid, crotonic acid or from other carboxylic acid containing groups. The hydrophobic component of the polymeric dispersant may include electron-rich functional groups or long chain hydrocarbons. Such functional groups are known to exhibit strong interaction and/or adsorption properties with respect to particle surfaces such as the colorant and the polyester binder resin of the polyester resin emulsion.

The protective colloid component of the polymeric dispersant provides extra stability besides the hydrophilic component in an aqueous system. Use of the protective colloid component substantially reduces amount of the ionic monomer segment or the hydrophilic component in the polymeric dispersant. Further, the protective colloid component stabilizes the polymeric dispersant in lower acidic media. The protective colloid component generally includes polyethylene glycol (PEG) groups.

The protective colloid component may be sourced from a reactive surfactant. Reactive surfactants may include nonylphenoxy poly(ethyleneoxy) acrylate (containing from about 1 to 40 moles of ethylene oxide), nonylphenoxy poly (ethyleneoxy) methacrylate (containing from 1 to about 40 moles of ethylene oxide), nonylphenoxy poly(ethyleneoxy) crotonate (containing from about 1 to about 40 moles of ethylene oxide), bis-nonylphenoxy poly(ethyleneoxy) fumerate (containing from about 1 to about 40 moles of ethylene oxide), phenoxypoly(ethyleneoxy) acrylate (containing from about 1 to about 40 moles of ethylene oxide), perfluoroheptoxypoly (propyloxy) acrylate, perfluoroheptoxypoly (propyloxy) methacrylate, sorbitol acrylate, sorbitol methacrylate, and allyl methoxy triethylene glycol ether.

A commercially available monomer for use in the hydrophobic component and the protective colloid component includes poly (ethylene glycol) 2, 4, 6-tris-(1-phenylethyl) phenyl ether methacrylate available from Rhodia, USA of Cranbury, N.J. under the trade name SIPOMER/SEM 25.

Other examples include polydimethylsiloxane methacrylate from Gelest, Inc., polypropylene glycol nonylphenylether acrylate from Toagosei Co. under the trade name ARONIX M-117, and polydimethylsiloxane-co-polypropylene glycol methacrylate.

The toner formulation of the present disclosure also includes a fuser release agent. More specifically, the toner formulation includes a wax dispersion as the fuser release agent. Use of the wax dispersion helps in improving fixing ability of the toner formulation when used in an image fixing apparatus for electrophotographic printing purposes. The wax dispersion may be prepared in water, along with a dispersant. The dispersant for the wax dispersion may be a polymeric-based dispersant that includes hydrophobic (e.g. styrene) and hydrophilic (e.g. acrylic acid) repeating unit functionality. It should be understood that the polymeric-based dispersant for the wax dispersion may be similar to the polymeric dispersant used in the colorant dispersion in terms of composition and properties.

For the purpose of this description, the wax dispersion comprises wax that has a melting point of about 60° C. to about 135° C., and more specifically, of about 70° C. to about 120° C. The wax, as used herein, may be present in a specific amount in order to have a final amount of about 2 to about 15 percent by weight of total weight of toner particles of the toner formulation. Suitable examples of the wax may include, but are not limited to polyolefin wax, ester wax, polyester wax, metal salts of fatty acids, fatty acid esters, partially saponified fatty acid esters, higher fatty acid esters, higher alcohols, paraffin wax, amide waxes and polyhydric alcohol esters. More specifically, the wax, as used herein, may be carnuba wax and mixture thereof.

The toner formulation of the present disclosure may also include one or more charge control agents (hereinafter referred to as "charge control agents"), which may optionally be used for preparing the toner formulation. More specifically, the charge control agents assist in production and stability of a tribocharge in the toner formulation. Further, the charge control agents help in preventing deterioration of charge properties of the toner formulation. The charge control agents, as used herein, may include the charge control agents that are known in the art. Additionally, the charge control agents may also be incorporated in the form of dispersion, which may be prepared in a manner similar to that of the colorant dispersion.

In addition to the above-indicated components, the toner formulation may include one or more additives (hereinafter referred to as "additives"), such as acids and/or bases, emulsifiers, UV absorbers, plasticizers and combinations thereof. Such additives may be required for enhancing properties of an image, printed using the toner formulation. For example, to increase UV light fade resistance, UV absorbers may be included in the toner formulation to prevent gradual fading of the image upon subsequent exposures to ultraviolet radiations. Suitable examples of the UV absorbers include, but are not limited to, benzophenone, benzotriazole, acetanilide, triazine and derivatives thereof. Commercial plasticizers that are known in the art may also be used to adjust the coalescening temperature of the toner formulation.

In another aspect, a method is provided for preparing the above-described toner formulation by using an extrusion process followed by an emulsion aggregation process. The method includes extruding the polyester binder resins to form the extruded polyester binder resin, which has a broad molecular weight distribution.

More specifically, the method includes melt-mixing of the polyester binder resins using a toner melt-mixing equipment, such as a melt-mixer, to breakdown cross-links of the polyester binder resins prior to conducting the emulsion aggregation process. Even more specifically, the polyester binder resins are blended and extruded in the melt-mixer at a specific feed rate at specific value of revolutions per minute (rpm). For the purpose of this description, the melt-mixer is a twin-screw extruder. As described before, the extruded polyester binder resin obtained by extruding the polyester binder resins for one or more times in the melt-mixer is characterized by the cross-linked gel content of less than or equal to about 5 percent (%). Preparation of the extruded polyester binder resin of the present disclosure is explained in conjunction with the following two examples.

In one example, Tuftone NE-2158N and Tuftone NE-2141N from Kao Corporation had been blended in a ZSK-30 twin-screw extruder at a feed rate of about 45 pounds per hour (lbs/hr) at 300 revolutions per minute. The extruder reached a maximum temperature of about 180° C. at die exit. The following Table 1 depicts change in physical properties that occurred by extruding highly cross-linked polyester binder resins one and two times. Values of weight-average molecular weight (Mw), number average molecular weight (Mn) and Z-average molecular weight, as depicted in Table 1, were calculated using GPC. Values of molecular weight distribution as depicted in Tables 1 and 2 were calculated according to the equation for polydisperity (PD) known in the art (PD=Mw/Mn). Further, values for Tg, as depicted in Table 1, were calculated using second scan DSC. Values of gel content were determined by the chloroform ($CHCl_3$) insolubles test.

TABLE 1

| | Polyester Binder Resin | | | | |
|---|---|---|---|---|---|
| Melt-mixing Properties | NE-2141N | NE-2158N | Binder L-6 | Binder L-6 (pre-extruded once) | Binder L-6 (pre-extruded twice) |
| Acid Value (mg of KOH/gm) | 32 | 23 | 24 | 29 | 29 |
| Gel Content in $CHCl_3$ (% by weight of the resin) | 1 | 32 | 22-23 | 0 | 0 |
| Mw | 18,000 | 49,000 | 22,200 | 250,000 | 217,000 |
| Mn | 3,400 | 3,500 | 3,510 | 3,860 | 3,880 |
| Z-Average Molecular Weight | 63,000 | 577,000 | 112,000 | 14,000,000 | 10,000,000 |
| Molecular Weight Distribution (PD) | 5 | 14 | 6 | 65 | 56 |
| Tg, ° C. (onset/midpoint) | 58/61 | 61/64 | 59/62 | 59/62 | 59/62 |

The term, "pre-extruded," as used in Table 1, relates to a pre-emulsified form of the extruded polyester binder resin, which is formed by the melt-mixing process. More specifically, the pre-extruded form is a functionalized form/blend of the polyester binder resins, which is used to form a polyester binder resin emulsion. Accordingly, it should be understood that pre-extrusion process helps in breaking cross-links of the polyester binder resins and in increasing the molecular weight distribution. It should be apparent to a person skilled in the art that specific melt-mixing properties of the polyester binder resins may easily be adjusted to obtain as much gel breakdown as needed using the above-described extrusion process.

As depicted in Table 1, molecular weight distribution is small for pure NE-2141N polyester binder resin and NE-2158N polyester binder resin, and for Binder L-6, which is a dry blend of the NE-2158N polyester binder resin and the NE-2141N polyester binder resin when present in a ratio of about 60:40. Further, it may be seen that both the NE-2158N polyester binder resin and the Binder L-6 have a high degree of gel content. However, after extrusion, the gel content of the extruded Binder L-6 reduced to about zero and the molecular weight distribution increased tremendously to about 65. Accordingly, it should be apparent to a person skilled in the art that the extrusion process allows the two polyester binder resins to homogeneously mix with each other to form an extruded polyester binder resin having a broad molecular weight distribution, which allows for preparing a toner formulation with good fusing, printing and durability properties.

It should be understood that the polyester binder resins need be extruded only once to attain an extruded polyester binder resin with a broad molecular weight distribution. However, the polyester binder resins may be extruded a number of times for optimization of the melt-mixing properties, thereby yielding an effective extruded polyester binder resin for preparing the toner formulation of the present disclosure.

In another example, the NE-2158N polyester binder resin and the NE-2141N polyester binder resin were blended in a ratio of about 40:60 to form 100-2 polyester binder resin (hereinafter referred to as "100-2 resin"). Conditions for the extrusion process, as used herein, were identical to the conditions as specified for the extrusion of Binder L-6 as disclosed above. The following Table 2 depicts change in physical properties that occurred by extruding the 100-2 resin. In this example, ratio of high molecular weight polyester binder resin, i.e. NE-2158N polyester binder resin to low molecular weight resin, i.e. NE-2141N polyester binder resin was 40:60, as opposed to 60:40 for Binder L-6.

As depicted in Table 2, molecular weight distribution is small for the NE-2141N polyester binder resin, the NE-2158N polyester binder resin and the 100-2 resin. Further, it may be seen that both the NE-2158N polyester binder resin and the 100-2 resin have a high degree of gel content. However, after extrusion, the gel content of the 100-2 resin reduced to about five and the molecular weight distribution increased tremendously to about 39. A subsequent extrusion of the 100-2 resin further reduced the gel content to about zero and maintained the molecular weight distribution at a value of about 34.

It may be concluded by way of the above-disclosed two examples that an extruded polyester binder resin obtained using a high concentration of high molecular weight polyester binder resin has a broad molecular weight distribution as opposed to an extruded polyester binder resin, which is obtained using a low concentration of the high molecular weight polyester binder resin. For example, the extruded Binder L-6 has a broad/high molecular weight distribution as opposed to the extruded 100-2 resin.

It may also be concluded that an exclusive use of low molecular weight polyester binder resins for extrusion is not suitable for preparing an effective emulsion aggregation toner formulation for contact development and/or contact fusing applications. Typically, the low molecular weight polyester binder resins, such as NE-2141N polyester binder resin, are very brittle and exhibit poor fuse grade and crease resistance during an electrophotographic process. Further, such polyester binder resins are prone to undergo filming/deposition on various components of an electrophotographic printer, such as developer roll, doctoring blade and photoconductive drum. The term, "filming," as used herein, refers to unwanted residual toner formulation adhering and depositing on the various components of the electrophotographic printer during repeated image forming operations, which causes deterioration of print quality.

It may further be concluded that the extrusion of the polyester binder resins for obtaining the extruded polyester binder resin greatly expands range of polyester properties that may be considered for the emulsion aggregation process. Further, polyester binder resins that include different monomers, acid values, softening temperatures and/or melt viscosities may easily be blended together in the melt-mixer. Furthermore, the extrusion process prevents the polyester binder resins from agglomerating differently in order to obtaining toner particles with narrow particle size distributions. Based on the foregoing, it should be apparent to a person skilled in the art that many different polyester binder resins may easily be

TABLE 2

| | Polyester Binder Resin | | | | |
|---|---|---|---|---|---|
| Melt-mixing Properties | NE-2141N | NE-2158N | 100-2 Resin | 100-2 Resin (pre-extruded once) | 100-2 Resin (pre-extruded twice) |
| Acid Value (mg of KOH per gram) | 32 | 23 | 30 | 30 | 30 |
| Gel Content in CHCl3 (% by weight of the resin) | 1 | 32 | 16 | 5 | 0 |
| Mw | 18,000 | 49,000 | 20,400 | 144,000 | 127,000 |
| Mn | 3,400 | 3,500 | 3,660 | 3,670 | 3,780 |
| Z-Average Molecular Weight | 63,000 | 577,000 | 86,000 | 11,000,000 | 8,000,000 |
| Molecular Weight Distribution (PD) | 5 | 14 | 6 | 39 | 34 |
| Tg, ° C. (onset/midpoint) | 58/61 | 61/64 | 59/62 | 59/62 | 59/62 |

incorporated into the melt-mixing process for a homogeneous mixing prior to the emulsion aggregation process. In addition, it is possible to melt-mix low acid value polyester binder resins with high acid value polyester binder resins.

To exhibit good fusing properties and resistance to filming, it is imperative to obtain widest acceptable fuse grade window for the polyester binder resins. The acceptable fuse grade window is confined within and includes values for maximum temperature where hot offset occurs and minimum temperature where unacceptable fuse grade is not obtained. The term, "hot offset," as used herein, refers to a temperature at which particles of a toner formulation, and more specifically, particles of a polyester binder resin of the toner formulation liquefy/melt in image areas and cause a splitting in the molten toner formulation. The splitting occurs when cohesive force holding viscous toner mass together is less than adhesive forces tending to offset it to a contacting surface of an electrophotographic printer, such as a developer roll, belt, or plate.

The following Table 3 shows a wide range of polyester fuse grade performance for various polyester binder resins including the extruded Binder L-6.

TABLE 3

| Polyester Binder Resin | Unacceptable Fuser Temperature (° C.) | Acceptable Fuser Temperature (° C.) | Hot Offset Temperature (° C.) |
|---|---|---|---|
| NE-701 | 185-190 | 195-220 | 225-230 |
| NE-2141N | 180-185 | 190 | 195-230 |
| TPESH-5 | 195-200 | 205-230 | — |
| W-85N | 180 | — | 185-230 |
| FH-2 | 195-200 | 205-230 | — |
| TPESL-11 | 190-200 | 205-215 | 220-230 |
| STPL-1 | 195-200 | 205-225 | 230 |
| Extruded Binder L-6 | 185 | 190-230 | — |
| Extruded SK ET-175/ETC-7372 | 195-205 | 210-230 | — |
| EM-189433/M-8400 | 195-210 | 215-230 | — |

As depicted in Table 3, the extruded L6 Binder has the widest acceptable fuse grade window of about 40° C. to 45° C., whereas the NE-2141N polyester binder resin and the W-85N polyester binder resin exhibit little or no acceptable fuse grade window. Such a poor polyester fuse grade performance is resultant of low molecular weights of the NE-2141N polyester binder resin and the W-85N polyester binder resin. Further, the NE-2141N polyester binder resin and the W-85N polyester binder resin are extremely brittle. Accordingly, the NE-2141N polyester binder resin and the W-85N polyester binder resin are not suitable for preparing effective toner formulations as opposed to the extruded L6 Binder. Based on the foregoing, it should be understood that pre-extruding/extruding cross-linked polyester binder resins, such as Binder L-6, helps in preparing an effective toner formulation for electrophotography.

Further, the method of the present disclosure includes preparing the polyester resin emulsion using the extruded polyester binder resin, as described above. Furthermore, the method includes combining and agglomerating the prepared polyester resin emulsion with the colorant dispersion and the wax dispersion to form the toner formulation. The colorant dispersion and the wax dispersion have been described before in detail in terms of respective compositions and properties.

The method, as described herein, employs acid agglomeration without using multivalent metal ions. More specifically, agglomeration of the polyester resin emulsion, the colorant dispersion and the wax dispersion may be achieved using an acid or a proton source (supplying proton neutralization), which is capable of promoting aggregation for formation of aggregated toner particles. The aggregated toner particles may then be heated to enable coalescence/fusing (e.g. at a temperature above Tg of the extruded polyester binder resin of the polyester resin emulsion), thereby achieving aggregated and fused toner particles. The toner particles produced may have a specific mean particle size (diameter) and a specific average degree of circularity for allowing the toner formulation to function as an effective toner formulation for electrophotography.

In addition, the method may include addition of one or more charge control agents (hereinafter referred to as "charge control agents") prior to agglomerating the prepared polyester resin emulsion with the colorant dispersion and the wax dispersion. The charge control agents have been described before in detail in terms of respective compositions and properties.

It should be noted that various features of the indicated components may be adjusted to facilitate aggregation and formation of toner particles of desired size and geometry. It may therefore be appreciated that by controlling the indicated components, relatively stable emulsions and/or dispersions may be formed, wherein aggregation may proceed along with relatively easy control of final toner particle size for use in electrophotography.

Without departing from the scope of the present disclosure, it should be understood that various conventional emulsion aggregation processes may be employed to prepare the polyester resin emulsion, and thereafter, to prepare the toner formulation by combining and agglomerating the prepared polyester resin emulsion with the colorant dispersion and the wax dispersion. Preparation of the polyester resin emulsion, the polymeric dispersant, the colorant dispersion, the wax dispersion, and the toner formulation of the present disclosure is explained in detail in conjunction with the following non-limiting examples. However, one of ordinary skill in the art, and based on a reading of this detailed description, would recognize that, the specific examples are intended to illustrate, not limit, the scope of the present disclosure.

Polyester Resin Emulsion

The polyester resin emulsion was prepared by mechanically blending and/or grinding 150 grams (g) of an extruded polyester binder resin, such as an extruded polyester resin formed using NE-2141N polyester binder resin and NE-2158N polyester binder resin when present in a ratio of about 60:40. The blended and/or ground form of the extruded polyester binder resin was then dissolved in about 450 g of MEK. Once dissolved in the organic solvent, the solution of the extruded polyester binder resin was combined with a mixture of about 500 g of deionized water and 7.5 g of $NH_4OH$ of about 10% solution at high speed using an IKA Ultra Turrax homogenizer. The solution was stirred for an additional 2 to 4 minutes and MEK was then removed with the help of a rotary evaporator under vacuum. The solution was then allowed to cool to room temperature. A microfluidizer may be used to adjust particle size of emulsion particles of polyester in the so obtained polyester resin emulsion. More specifically, final particle size was obtained to be about 100 to 200 nanometers (nm) and pH of the polyester resin emulsion was controlled at a value of about 7.50.

Polymeric Dispersant

The following method was used for preparing the polymeric dispersant of the toner formulation of the present disclosure. About 80 g of SIPOMER/SEM-25 (containing 60% active ingredient, 20% acid and 20% water); about 12.6 g of ARONIX M-117; about 23.6 g of methacrylic acid, about 6.4 g of 1-dodecanethiol; and about 0.30 g of dimethyl 2, 2'-azobisisobutyrate (V-601) was mixed in 80 milliliters (ml) of isopropyl alcohol in a three neck round bottom flask equipped with a mechanical stirrer, a condenser and a thermometer. The above-specified chemicals were mixed together and degassed with nitrogen (by repeated partial evacuation followed by backfill using a Firestone Valve obtained from Sigma or Aldrich Chemical). The flask was back filled with nitrogen, and then immersed, in an oil bath, and, was heated to about 78° C. with good stirring for 18 hours. Product so obtained from the flask was then dried in an oven at 80° C. Subsequently, molecular weight of the product was determined by GPC. The product had a value of Mw of about 9305 and a value of Mn of about 6615. The product was then dissolved in deionized water with heating to form a solution of the polymeric dispersant. Temperature of the solution was controlled to below 50° C. Further, pH of the solution was adjusted to 7.8 by a drop-wise addition of 20% KOH to the solution.

Colorant Dispersion

The following method was used for preparing an exemplary colorant dispersion, and more specifically, a pigment dispersion, to be employed in the toner formulation of the present disclosure. About 28.6 g of the polymeric dispersant was taken and deionized water was added to the polymeric dispersant until total amount of the deionized water was about 900 g. The polymeric dispersant and the deionized water were mixed in an electrical stirrer and 100 g of a pigment, such as PR122 magenta pigment, was slowly added to the mixture. When the pigment was completely wetted and dispersed, then the mixture was added to a microfluidizer (an apparatus to reduce particle size). Subsequently, the mixture was run in the microfluidizer until particle size was about 200 nm. While achieving the set particle size, the mixture was cooled by a continuous addition of relatively cold water to specific compartment of the microfluidizer that contained heat exchanger coil.

The final pigment dispersion was set to include about 10 to 15% solids by weight. Without departing from the scope of the present disclosure, one or more charge control agents may be added along with the pigment. It should be apparent to a person skilled in the art that any other suitable pigment such as PR184 pigment may also be utilized for preparing the pigment dispersion. It should also be apparent to a person skilled in the art that the above-described method may be used when more than one colorant dispersion is employed for preparing the toner formulation. It should also be understood that use of more than one colorant dispersion may employ more than one dispersant, such as the polymeric dispersant, as described above.

Alternatively, the pigment dispersion may be prepared using Akypo RLM-100 surfactant as a dispersant, which is a long chain hydrocarbon polyethylene glycol carboxylic acid. Such a pigment dispersion may include a ratio of the pigment to the dispersant (P:D) of about 5:1.

When using a dye as the colorant, then an emulsion of the dye may be obtained by dissolving the dye in the organic solvent with the extruded polyester binder resin.

Wax Dispersion

The following method was used for preparing an exemplary wax dispersion to be employed in the toner formulation of the present disclosure. About 4.7 g of Akypo RLM-100 surfactant was measured to which deionized water was added until total amount of the deionized water was about 500 g. Subsequently, the mixture was run through a microfluidizer until temperature of the mixture reached to about 90° C. About 52 g of carnuba wax was then slowly added to the mixture while keeping the temperature at about 90° C. (fluctuating between 85° C. and 95° C.) for 15 minutes to obtain a wax emulsion. Subsequently, particle size of the so obtained wax emulsion was recorded for every 5 minutes after about 15 minutes from the time when the temperature was maintained at about 90° C. The wax emulsion was then removed from the microfluidizer when the particle size was below 200 nm. The wax emulsion/dispersion was stirred until it reached room temperature.

Toner Formulations

The emulsion aggregation process for preparing exemplary toner formulations of the present disclosure is explained in detail in conjunction with the following non-limiting examples. However, one of ordinary skill in the art, and based on a reading of this detailed description with regard to preparation of the toner formulations, would recognize that, the specific examples are intended to illustrate, not limit, the scope of the present disclosure.

Toner Formulation A

An exemplary toner formulation A was obtained using all or some of the above-described components. More specifically, 150 g (solid) of a polyester resin emulsion (formed using extruded polyester binder resin with NE-2158N and NE-2141N in a ratio of about 60:40) in water; 35.8 g of PR122 magenta pigment dispersion (formed using polymeric dispersant) with 30% solid and a P:D ratio of about 5:1; 15.1 g of PR184 pigment dispersion (formed using surfactant) with 31% solid and a P:D ratio of about 5:1 and some charge control agents; 58 g of carnuba wax emulsion with 16.8% solid and a wax to dispersant ratio of about 11:1 and 1 g of Akypo surfactant were combined using a high shear mixer (such as an IKA Ultra Turrax homogenizer) to promote relatively even dispersion. Subsequently, 350 g of 2% nitric acid was added to the mixture to promote aggregation and speed of the homogenizer was increased to break any clumps that had formed in the mixture.

Agglomerate so obtained was then poured into a reaction flask and 100 grams of water was used to rinse the beaker and homogenizer shaft, which were employed while preparing the toner formulation. Particle size of agglomerated particles was tracked as the temperature of the agglomerate was increased while maintaining pH below 6 with 6% NaOH. When the particle size reached the target of about 5 μm, the temperature of the agglomerate was maintained at about 55° C. for 3 hours, and then the temperature was raised to 90° C. for 30 minutes. Circularity and particle size of toner particles so obtained were analyzed using SYSMEX particle analyzer. The circularity of the toner particles was observed to be about 0.94. The particle size of the toner particles was adjusted to be about 5.83 μm with 4.3% of toner particles, which were smaller than 2 μm.

Toner Formulation B

Another exemplary toner formulation B was obtained using all or some of the above-described components. More specifically, 150 g (solid) of the polyester resin emulsion (formed using extruded polyester binder resin with NE-2158N and NE-2141N in a ratio of about 40:60) in water; 35.8 g of PR122 magenta pigment dispersion (formed using polymeric dispersant) with 30% solid and a P:D ratio of about 5:1; 15.1 g of PR184 pigment dispersion (formed using surfactant) with 31% solid and a P:D ratio of about 5:1 and some charge control agents; 58 g of carnuba wax emulsion with 16.8% solid and a wax to dispersant ratio of about 11:1 and 1 g of Akypo surfactant were combined using a high shear mixer (such as an IKA Ultra Turrax homogenizer) to promote relatively even dispersion. Subsequently, 350 g of 2% nitric acid was added to the mixture to promote aggregation and the speed of the homogenizer was increased to break any clumps that had formed in the mixture.

Agglomerate so obtained was then poured into a reaction flask and 100 grams of water was used to rinse the beaker and Tekmar shaft that were employed while preparing the toner formulation. Particle size of agglomerated particles was tracked as the temperature of the agglomerate was increased while maintaining pH below 6 with 6% NaOH. When the particle size reached the target of about 5 μm, the temperature of the agglomerate was maintained at about 55° C. for 3 hours, and then the agglomerate was cooled down. Such mixture of the agglomerate was transferred to a parr reactor, and 1.5 g (solid) of lauryl sulfate solution was added to the mixture. The temperature of the mixture was then quickly raised to 110° C. Further, this temperature was maintained for 23 minutes. Subsequently, the mixture was cooled to room temperature. Circularity of toner particles so obtained was observed to be about 0.96 using SYSMEX particle analyzer. Further, particle size was observed to be about 6.54 μm with 3.5% of the toner particles, which were smaller than 2 μm.

The above-described exemplary toner formulations were tested in electrophotographic printers (obtained from Lexmark International, Inc.). Evaluation of charge (in microcoulombs, μC), mass (in milligrams, mg) and filming characteristics of the exemplary toner formulations is depicted in Table 4. More specifically, the evaluation of the charge, mass and filming characteristics was done at a process speed of about 35 pages per minute (ppm).

TABLE 4

| Toner Formulation | Charge (Q) μC | Mass (M) mg | Q/M μC/mg | Mass/Area (M/A) mg/cm$^2$ | Q/A nC/cm$^2$ |
|---|---|---|---|---|---|
| A | 0.161 | 0.0048 | 33.5 | 0.48 | 16.10 |
| A (1 hour) | 0.133 | 0.0043 | 30.9 | 0.43 | 13.30 |
| A (2.5 hours) | 0.135 | 0.0042 | 32.1 | 0.42 | 13.50 |
| A (3.5 hours) | 0.162 | 0.0043 | 37.7 | 0.43 | 16.20 |
| A (4.5 hours) | 0.199 | 0.0049 | 40.6 | 0.49 | 19.90 |
| A (5.5 hours) | 0.194 | 0.0054 | 35.9 | 0.54 | 19.40 |
| B | 0.248 | 0.0105 | 23.6 | 1.05 | 24.08 |
| B (1 hour) | 0.196 | 0.0076 | 25.8 | 0.76 | 19.60 |
| B (2.5 hours) | 0.202 | 0.0069 | 29.3 | 0.69 | 20.20 |
| B (3.5 hours) | 0.256 | 0.0070 | 36.6 | 0.70 | 25.60 |
| B (4.5 hours) | 0.290 | 0.0074 | 39.2 | 0.74 | 29.00 |
| B (5.5 hours) | 0.296 | 0.0078 | 37.9 | 0.78 | 29.60 |

The term, "A," as used in Table 4, refers to area (in square centimeters, cm$^2$), and more specifically, to surface area, of a specific component of the electrophotographic printer on which the exemplary toner formulations were evaluated for deposition in terms of filming characteristics, and for charge and mass stability.

As depicted in Table 4, the exemplary toner formulations A and B exhibited good charge and mass. They were also capable of exhibiting resistance to filming and resistance to adherence over the various components of the electrophotographic printer. More specifically, the exemplary toner formulations A and B were capable of exhibiting good charge and mass stability even after 5.5 hours after the start of the electrophotographic process. More specifically, the exemplary toner formulations A and B were capable of exhibiting good charge, mass, and accordingly, good electric charge even after continuous printing operation. Accordingly, it may be concluded that the exemplary toner formulations of the present disclosure provide good filming resistance to the various components of an electrophotographic printer.

Evaluation of fusing characteristics (hereinafter interchangeably referred to as "fuse grade performance") of the exemplary toner formulations is provided in Table 5. The fuse grade performance was evaluated using HP 4300 fuser. Further, the evaluation was done at a process speed of about 50 ppm.

More specifically, the fuse grade performance was evaluated by scratching fused exemplary toner formulations with a fingernail and comparing results with an internal grading system, such as Taber Abrader provided with a scale of 1 to 10. A fuse grade of greater than or equal to 5 at a specific temperature was considered acceptable and effective in light of the fusing characteristics of the exemplary toner formulations. More specifically, a fuse grade of less than 5 at a specific temperature was considered as unacceptable fuse grade associated with scratch failure. Accordingly, it should be understood that higher the value of the fuse grade, the better the fusing. Temperature as indicated in Table 5 is the temperature of heating element/heater of an electrophotographic printer.

TABLE 5

| Temperature | Fuse Grade | | |
|---|---|---|---|
| (° C.) | Control | Toner Formulation A | Toner Formulation B |
| 165 | — | — | — |
| 170 | — | — | — |
| 175 | — | — | 2 |
| 180 | — | — | 4.5 |
| 185 | — | 2 | 9 |
| 190 | 2 | 4.5 | 10 |
| 195 | 4.5 | 9 | 10 |
| 200 | 6 | 10 | 10 |
| 205 | 8 | 10 | 10 |
| 210 | 9 | 10 | 10 |
| 215 | 10 | 10 | 10 |
| 220 | 10 | 10 | 10 |
| 225 | 10 | 10 | 10 |
| 230 | 10 | 10 | Hot Offset |

As depicted in Table 5, the exemplary toner formulations exhibited good fusing grade performance as opposed to the control toner formulation. More specifically, the exemplary toner formulations A and B exhibited a wide fuse grade window. Even more specifically, the exemplary toner formulation B exhibited a fuse grade window of about 45° C. of acceptable fuse grade. This range of fuse grade window included temperatures, which were sufficient for proper fusing of the exemplary toner formulation B onto a printing medium, such as paper, to provide a permanent image thereon. It may also be observed that the exemplary toner formulations exhibited low minimum acceptable fuse grade temperature. Further, it was observed that the exemplary toner formulations were capable of providing images with glossy print.

The present disclosure provides a polyester-based emulsion aggregation toner formulation and a method for preparation thereof. More specifically, the present disclosure provides an effective method for preparing the polyester-based emulsion aggregation toner formulation with a broad/high molecular weight distribution. The broad molecular weight distribution enables the polyester-based emulsion aggregation toner formulation to exhibit good fusibility without sacrificing shipping/storage performance or durability. Further, the broad molecular weight distribution enables the polyester-based emulsion aggregation toner formulation to tolerate rigorous electrophotographic process.

The method as described hereinbefore involves use of a toner melt-mixing equipment to breakdown cross-links of polyester binder resins prior to an emulsion aggregation process by extruding the polyester binder resins one or more times in the melt-mixing equipment still maintaining a very broad molecular weight distribution. This allows the extruded polyester binder resin to quickly dissolve into an organic solvent while preparing a polyester resin emulsion to form small-sized emulsion particles. Further, use of the extruded polyester binder resin enables the polyester-based emulsion aggregation toner formulation to have a very wide fuse grade window, low minimum acceptable fuse grade temperature, glossy print and good resistance to filming various components of an electrophotographic printer, such as developer roll and doctoring blade.

Furthermore, the above-described method serves as an effective tool for preparing polyester-based emulsion aggregation toner formulations from polyester polymers with very low acid values. In addition, the polyester polymers, which may include different monomers, different acid values, different glass transition temperatures, different gel content values, different softening temperatures and/or different melt viscosities, may easily be blended together in the melt-mixing equipment. Moreover, the method easily allows for use of two or more polyester resin emulsions to obtain necessary physical and thermal properties required for the high speed and/or high stress electrophotographic process.

The foregoing description of several embodiments of the present disclosure has been presented for purposes of illustration. It is not intended to be exhaustive or to limit the present disclosure to the precise forms disclosed, and obviously many modifications and variations are possible in light of the above teaching. It is intended that the scope of the present disclosure be defined by the claims appended hereto.

What is claimed is:

1. A method for preparing an emulsion aggregation toner formulation for electrophotography, the method comprising:

loading a plurality of pre-emulsified cross-linked polyester binder resins into an extruder and extruding the plurality of pre-emulsified cross-linked polyester binder resins together in their pre-emulsified state to break down the cross-links in the polyester binder resins and form an extruded polyester binder resin that is characterized by a cross-linked gel content of less than or equal to about 5 percent by weight of the extruded polyester binder resin and has a broader molecular weight distribution than the pre-emulsified polyester binder resins;

after extruding the plurality of pre-emulsified cross-linked polyester binder resins and forming the extruded polyester binder resin, preparing a polyester resin emulsion using the extruded polyester binder resin; and combining and agglomerating the prepared polyester resin emulsion with at least one colorant dispersion and a wax dispersion to form the emulsion aggregation toner formulation.

2. The method of claim 1 wherein each of the plurality of pre-emulsified cross-linked polyester binder resins has an acid value of less than or equal to about 40 milligrams of KOH per gram.

3. The method of claim 1 wherein each of the plurality of pre-emulsified cross-linked polyester binder resins has a glass transition temperature of about 40 to about 75 degrees Celsius.

4. The method of claim 1 wherein each of the plurality of ore-emulsified cross-linked polyester binder resins has a softening temperature of about 80 to about 150 degrees Celsius.

5. The method of claim 1 wherein each of the plurality of pre-emulsified cross-linked polyester binder resins is selected from the group consisting of a semi-crystalline polyester binder resin, a crystalline polyester binder resin, an amorphous polyester binder resin and a polyester copolymer binder resin.

6. The method of claim 1 wherein the at least one colorant dispersion comprises a self-dispersing colorant selected from the group consisting of dyes, pigments and combinations thereof.

7. The method of claim 1 wherein the at least one colorant dispersion comprises:

a colorant, the colorant selected from the group consisting of dyes, pigments and combinations thereof; and a dispersant, the dispersant selected from the group consisting of a surfactant, a polymeric dispersant and a combination thereof.

8. The method of claim 1 wherein the wax dispersion comprises wax having a melting point of about 60 to about 135 degrees Celsius.

9. The method of claim 1 further comprising adding one or more charge control agents prior to agglomerating the prepared polyester resin emulsion with the at least one colorant dispersion and the wax dispersion.

10. A method for preparing an emulsion aggregation toner formulation for electrophotography, the method comprising:

loading a plurality of dry cross-linked polyester binder resins into an extruder and melt mixing the plurality of cross-linked polyester binder resins in the extruder to break down the cross-links in the polyester binder resins and form an extruded polyester binder resin that is characterized by a cross-linked gel content of less than or equal to about 5 percent by weight of the extruded polyester binder resin and has a broader molecular weight distribution than the plurality of dry polyester binder resins, after melt mixing the plurality of dry cross-linked polyester binder resins and forming the extruded polyester binder resin, preparing a polyester resin emulsion using the extruded polyester binder resin; and combining and agglomerating the prepared polyester resin emulsion with at least one colorant dispersion and a wax dispersion using acid agglomeration without using multivalent metal ions to form the emulsion aggregation toner formulation.

11. The method of claim 10 wherein each of the plurality of pre-emulsified cross-linked polyester binder resins has an acid value of less than or equal to about 40 milligrams of KOH per gram.

12. The method of claim 10 wherein each of the plurality of pre-emulsified cross-linked polyester binder resins has a glass transition temperature of about 40 to about 75 degrees Celsius.

13. The method of claim 10 wherein each of the plurality of ore-emulsified cross-linked polyester binder resins has a softening temperature of about 80 to about 150 degrees Celsius.

14. The method of claim 10 wherein each of the plurality of pre-emulsified cross-linked polyester binder resins is selected from the group consisting of a semi-crystalline polyester binder resin, a crystalline polyester binder resin, an amorphous polyester binder resin and a polyester copolymer binder resin.

15. The method of claim 10 wherein the at least one colorant dispersion comprises a self-dispersing colorant selected from the group consisting of dyes, pigments and combinations thereof.

16. The method of claim 10 wherein the at least one colorant dispersion comprises:

a colorant, the colorant selected from the group consisting of dyes, pigments and combinations thereof; and a dispersant, the dispersant selected from the group consisting of a surfactant, a polymeric dispersant and a combination thereof.

17. The method of claim 10 wherein the wax dispersion comprises wax having a melting point of about 60 to about 135 degrees Celsius.

18. The method of claim 10 further comprising adding one or more charge control agents prior to agglomerating the prepared polyester resin emulsion with the at least one colorant dispersion and the wax dispersion.

* * * * *